US009661946B2

(12) United States Patent
Stammnitz et al.

(10) Patent No.: US 9,661,946 B2
(45) Date of Patent: May 30, 2017

(54) COMBINATION COAT HOOK, TOWEL BAR AND HANGER RACK

(71) Applicants: Cynthia Stammnitz, Cameron Park, CA (US); Ray Stammnitz, Cameron Park, CA (US)

(72) Inventors: Cynthia Stammnitz, Cameron Park, CA (US); Ray Stammnitz, Cameron Park, CA (US)

(73) Assignee: FOUR ONE INNOVATIONS, LLC, Cameron Park, CA (US)

( * ) Notice: Subject to any disclaimer, the term of this patent is extended or adjusted under 35 U.S.C. 154(b) by 555 days.

(21) Appl. No.: 13/999,455

(22) Filed: Feb. 27, 2014

(65) Prior Publication Data

US 2016/0286995 A1 Oct. 6, 2016

(51) Int. Cl.
*A47G 25/06* (2006.01)
*A47K 10/10* (2006.01)

(52) U.S. Cl.
CPC ..... *A47G 25/0685* (2013.01); *A47G 25/0635* (2013.01); *A47G 25/0692* (2013.01); *A47K 10/10* (2013.01)

(58) Field of Classification Search
CPC .. A47G 25/06; A47G 25/0635; A47G 25/065; A47G 25/0664; A47G 25/0671; A47G 25/0685; A47G 25/0692; A47G 25/10; A47G 25/40; A47G 25/4046; E04F 10/0603
See application file for complete search history.

(56) References Cited

U.S. PATENT DOCUMENTS 434,343 A * 8/1890 Katherman ..... A47G 25/065 211/96
660,316 A * 10/1900 Shoenberg ..... A47G 25/065 211/96
975,273 A * 11/1910 Noppe ..... A47G 25/0685 211/97
1,373,460 A * 4/1921 Striker ..... A47G 25/0685 211/99
1,377,444 A * 5/1921 Shoemaker ..... A47G 25/0685 211/104
4,129,217 A * 12/1978 Campbell ..... B05B 15/1214 211/180
4,171,748 A * 10/1979 Fabian ..... A47G 25/0685 211/1.3
4,632,255 A * 12/1986 Kennedy ..... A47G 25/0685 211/1.3

(Continued)

*Primary Examiner* — Joshua Rodden
(74) *Attorney, Agent, or Firm* — Mark C. Jacobs

(57) ABSTRACT

A coat hook, towel rack and clothes hanger receiver, preferably includes a mounting board, to which is attached a pivoting means on which pivoting means is an elbow or elongated bar having an outer tube communicating at 90° thereto, wherein the outer tube has therein, an inner tube disposed within and vertically moveable in a middle tube, the middle tube being moveable through the outer tube and the elbow-bar, the inner tube having a finial on its external end. Flares prevent the middle tube from exiting the outer tube in both directions. When the inner tube is extended upwardly, it is rotatable 90° from a 12 o'clock-6 o'clock position to a 9 o'clock-3 o'clock position. Once oriented horizontally the inner tube may be returned inwardly or retained in an outward disposition.

28 Claims, 8 Drawing Sheets

(56) References Cited

U.S. PATENT DOCUMENTS

| | | | | |
|---|---|---|---|---|
| D359,379 | S * | 6/1995 | Haviland | D26/140 |
| 7,806,280 | B1 * | 10/2010 | Perkins | A47G 25/0685 211/100 |
| 7,886,918 | B1 * | 2/2011 | Sauer | A47G 25/0685 211/99 |
| 2009/0242500 | A1 * | 10/2009 | Li | A47G 25/0685 211/116 |

* cited by examiner

Fig. 7
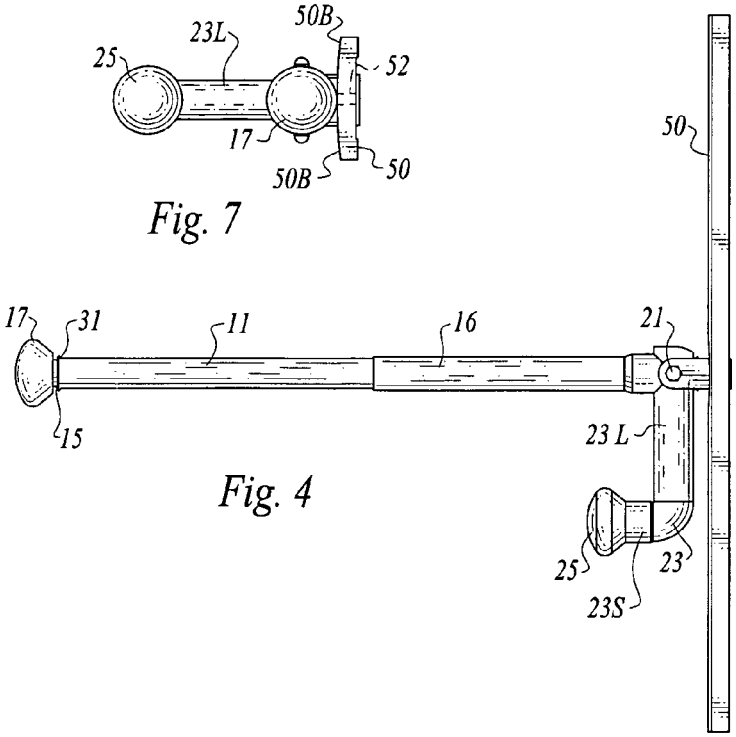
Fig. 4
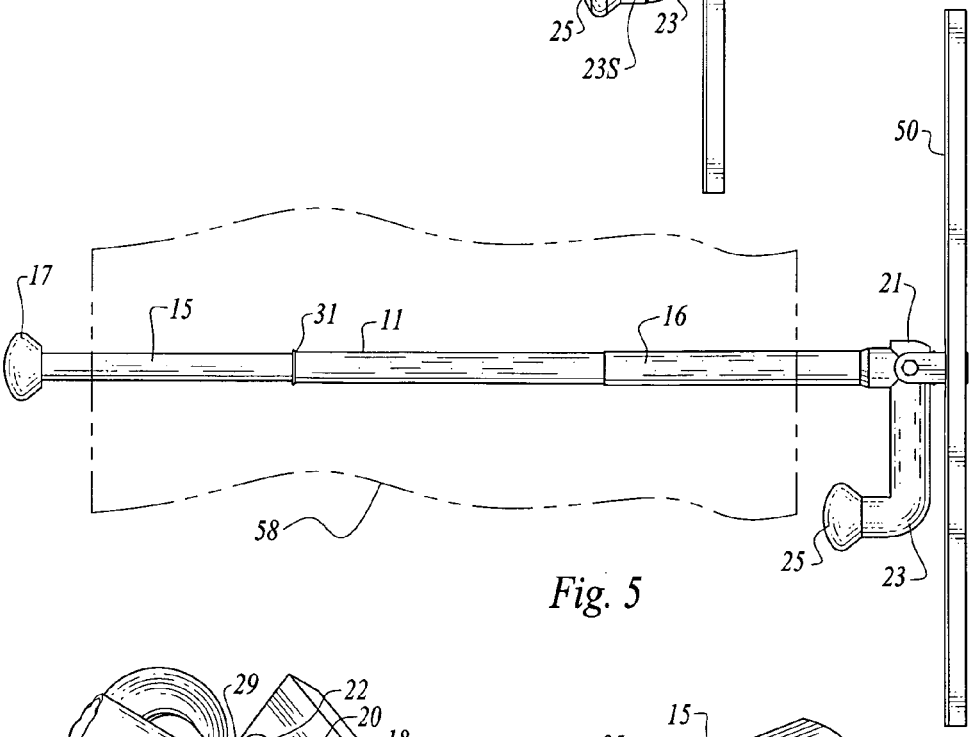
Fig. 5
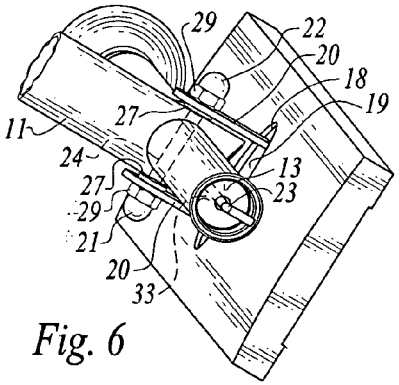
Fig. 6
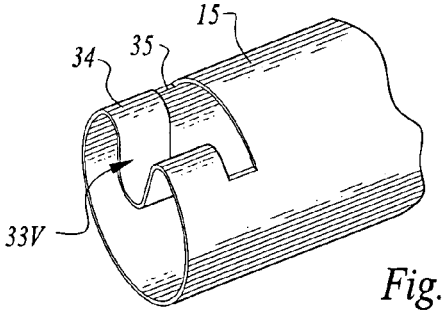
Fig. 8

COMBINATION COAT HOOK, TOWEL BAR AND HANGER RACK

FIELD OF INVENTION

This invention pertains to a wall mountable multi-use apparatus, that is easily converted from a first use as a coat hook to its second use as a towel rack. In a towel rack position the apparatus does double duty as a hanger rack and a coat hook as well. The better second use will depend on the locus in the house where the apparatus is mounted. In the laundry, the preferred use is as a hanger rack while in the kitchen or bath the second preferred use is as a towel rack.

BACKGROUND OF THE INVENTION

It has often been said that the best inventions are made by people creating something related to their vocation as opposed to their avocation or creating a development in an extraneous field. The reasoning goes, that those who can recognize a true need and then fill it, will have solved a problem that was known to exist.

In today's hectic world, where time is short and doing double duty is a key phrase in our vocabulary, the ability to develop a apparatus that serves multiple functions is indeed gratifying. When the item developed can serve three uses, that situation is most unique. The product of this invention does just that.

The apparatus of this invention finds utility in various rooms of the home, camper, RV, or dormitory including the kitchen, the bathroom, and the laundry. This apparatus is also ideal for use in vacation homes and individual dormitory rooms where space is at a premium.

The apparatus of this invention can be used as an ordinary coat hook for jackets, bathrobes and the like, as well as a towel rack when so oriented, or in the laundry or dormitory room as a place for the retention of clothes hangers on either a short or long term basis, depending upon the location and number of occupants.

KNOWN PRIOR ART

The Applicants have knowledge of the following prior art, none of which is believed to individually anticipate or in combination render this invention obvious to one skilled in the art.

| | |
|---|---|
| Patterson | U.S. Pat. No. 1,587,676 |
| Jones | U.S. Pat. No. 2,116,631 |
| Shouf | U.S. Pat. No. 4,051,953 |
| Thiot et al | U.S. Pat. No. 4,094,414 |
| Valentino | U.S. Pat. No. 5,850,828 |
| Smith | Design 0,271,546 |

SUMMARY OF THE INVENTION

The apparatus of this invention, preferably includes a mounting board, which adds style as well as rendering the apparatus more portable. To this mount board is attached a retainer base having a pivot bolt disposed within a pair of spaced arms for the first two embodiments, while the pivot is hidden for embodiments three and four. Disposed on the exposed pivot bolt is a cross member such as a moveable stylized J-shaped elbow having an outer tube which passes through a pair of aligned bores in the longer portion of the fallen J-shaped elbow. The cross member elbow may be either one continuous piece or two pieces, the second piece being a nipple, as may be desired. A telescoping long inner tube disposed within a middle tube rides in the outer tube.

When the cross member is in normal disposition as a reclining J, the inner tube is disposed down within the outer tube, retained by gravity and a stop member. When the inner tube is extended upwardly to its maximum, it can be rotated 90 degrees from a 12 o'clock-6 o'clock position to a 9 o'clock-3 o'clock position and the elbow assumes the normal J position. Once oriented horizontally the inner tube may be returned inwardly or retained in an outward disposition as may be desired. In both dispositions the cross member, can serve as a hat rest or coat hook. The third and fourth embodiments operate in a similar manner but employ a square tube closed off at its distal end in version #4 or a blunt nosed bar or tube instead of an elbow in version #3.

It is a first object therefore to provide a multi-utility apparatus.

It is a second object to provide an apparatus which can be used in various rooms of the house, apartment or RV or other residence by people of all ages.

It is a third object to provide a combination coat hook, towel rack and clothes hanger receiver all in one item.

It is a fourth object to provide a cosmetically appealing coat hook which can be easily moved from one location to another with minimal effort if so desired.

It is a fifth object to provide a multi-purpose coat hook-towel bar with a hidden pivot point for movement between two orientations.

Other objects of the invention will in part be obvious and will in part appear hereinafter.

The invention accordingly comprises the apparatus possessing the features, properties, and relation of components which are exemplified in the following detailed disclosure and the scope of which will be indicated in the appended claims.

For a fuller understanding of the nature and objects of the invention, the reader should make reference to the following detailed description taken in conjunction with the accompanying drawings, and as exemplified in the claims at the end hereof.

BRIEF DESCRIPTION OF THE DRAWINGS

FIG. 4 is view related to FIG. 3 showing the inner arm fully rotated to the horizontal position and the cross member elbow's longer section 23-L disposed downwardly and its shorter section 23-S disposed horizontally.

FIG. 5 is a view similar to FIG. 4 but with the inner arm extended outwardly.

FIG. 6 is a closeup bottom view of the elbow's proximal end showing the stop for the inner tube, and the mounting to the retainer base.

FIG. 7 is a top plan view of the first embodiment mounted apparatus of this invention.

FIG. 8 is a closeup view of one means for the closure for the inner tube to prevent the inner tube from exiting out the top/forward end of the middle tube, when used in conjunction with another element as shown in FIG. 10.

DESCRIPTION OF THE PREFERRED EMBODIMENT

Figure 1:
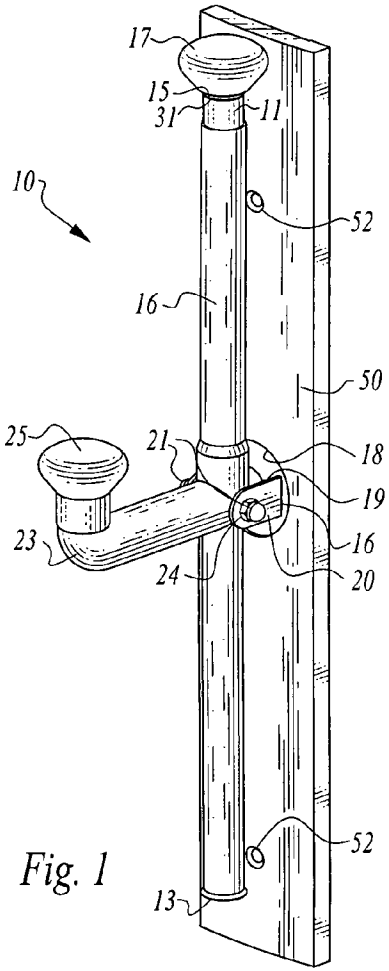
FIG. 1 is a front right perspective view of the apparatus of this invention attached to a mounting board.

In FIG. 1, a perspective view of the apparatus of this invention, one sees the apparatus 10 disposed upon a mount board 50. The mount board may be wood, plastic, MDF—medium density fiber board- or any other suitable material such as a metal plate. The configuration of the mount board 50 may be rectangular in cross section as shown elsewhere herein, or it may be fancy and have an arcuate front face as is seen here.

An elongated vertical recess 18 may be molded in or routed out of the mount board 50, to receive the retainer base 19. This recess is about 1.5 inches in diameter and about ⅛th inch deep. The purpose is to hide the central longitudinal section of the retainer base. The retainer base 19 may be inserted through two spaced slots 16 such that the central section of the retainer base abuts the rear face of the mount board as seen here. Or in the alternative but not illustrated the two slots 16 can be omitted and the central section of the retainer base can be screwed directly from the front into the mount board. The former mode is more cosmetically appealing but this is a matter of design choice.

Figure 12:
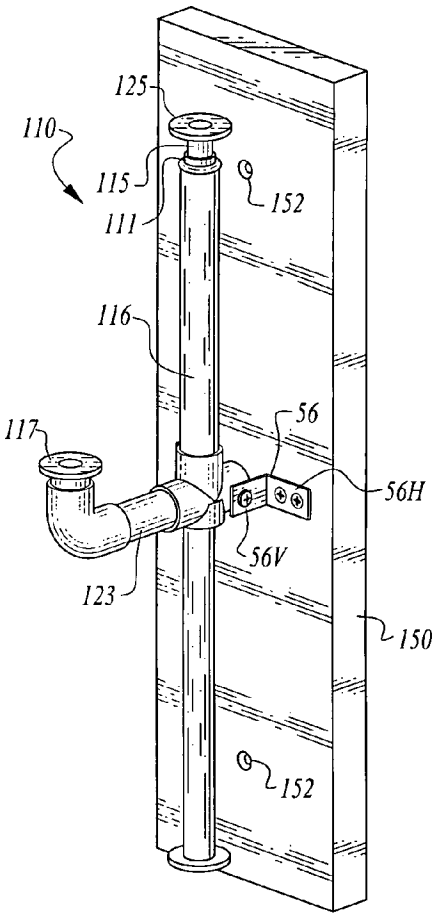
FIG. 12 is a view similar to FIG. 1 but showing the second embodiment mount board and second embodiment retainer arms.

The retainer base may be made of metal such as steel or brass or even high impact plastic. It has a central section unseen here in this view, attached to the mount board from the rear and two spaced forwarding extending arms, 20 each with an aligned bore therein for the disposition of a pivot bolt 21 having threads at both ends thereof. The pivot bolt passes through a bore 24 seen in phantom line in FIG. 6 of the elbow 23. Let us explore element 23 a bit further. This element is further designated as the short tube. In FIG. 1, element 23 is an elongated tube that has had the curved portion cut off and the finial 25 attached over the opening. However in FIG. 4, a true elbow is shown for element 23, the short tube. Either configuration may be employed. In FIG. 12 the short tube is seen to be a pipe section with a small elbow attached to a nipple, the combination making up the short tube. And, in versions 3 and 4 infra, the short tube designated 328 is a bullet nosed tube with a finial thereon, and for 428 it is a closed off square tube also having a normally disposed finial thereon at the distal end thereof.

As also can be seen in FIG. 6, there are disposed on the pivot bolt a series of washers 27 and a hex nut 29 on the external surface of each of the two arms, and a cap nut 22 at the end of the pivot bolt to secure it from slipping out. Such a pivot mechanism is deemed conventional. A dual end threaded pin can also be utilized.

Let us now move to the discussion of the three tubes. Interior tube 15 telescopically nests within middle tube 11 which in turn can travel between withdrawn and extended passions in the outer tube 16. Tube 11 has an outward extending flange 31 at its top edge that serves as a stop for the travel of the middle lube 11 in a downwardly direction such that it can not fall through the bottom of the outer tube 16. Again see FIG. 6. At the top or upper end of tube 15 is a decorative finial of any desired configuration. It serves to prevent items be they hangers or a towel from sliding off the extended bar when the extended bar is in a horizontal disposition. Inner tube 15 which is about twelve inches long in the preferred embodiment is prevented from coming out of the top of the middle tube 11 by a closure means to be discussed infra.

Middle tube 11 has an outward extending lip or flare 13 at the bottom thereof. Mounted to the lip 13 is a stop 33 that limits the travel of the middle tube 11. See also FIG. 6. The stop 33 prevents the middle tube 11 which extends through the outer tube and the elbow from exiting out the top end of the outer tube 16, designated 16-T in FIG. 3. Middle tube 11 has a diameter slightly larger than that of inner tube 15 to permit tube 15 to move freely within tube 11.

Tube 16, the outer tube is slightly larger in diameter to the middle tube 11 to permit the middle tube to move freely therein back and forth to the limit points. See FIG. 10. The outer tube 16 is braised or soldered or welded or otherwise attached to the elbow 23 at the top surface thereof, at an opening in said elbow, spaced forwardly from the rear of the elbow. The outer tube may extend down into the elbow or terminate at the top surface thereof. A through opening 26, in the top and bottom surface of the longer section of the elbow, 23, is vertically aligned with the upper tube to permit the middle tube to pass through the outer tube which is disposed upon the elbow 23 around the periphery of this through opening, such that middle tube passes through the outer tube 16 and out the bottom of the elbow 23.

It is to be noted from the FIGS. that only the middle tube 11, tube exits the bore 26, at the underside of the elbow. Flare 13 as seen in FIG. 6 keeps the middle tube from being pulled through the outer tube 16, too far upwardly or outwardly away from the mount board 50, depending on the disposition of the invention 10 at any one time.

Elbow 23 is preferably about 0.75 inches in diameter, and in said elbow, the larger generally horizontal section is about 2.5 inches while the elevation of the smaller section is about 1.25 inches. The upturned section, 23S is closed off with a finial 25 which can be the same as or different from finial 17. See FIG. 1 or FIG. 2. The elbow as seen here is a one piece unit, which is curved upwardly at the distal end, and which can be secured as shown or the elbow 23 made from a pipe section to which is attached a short elbow. Either mode is within the skill of the art. The larger section of elbow 23, designated 23L extends about 0.5 inches behind the outer tube 16. The rear end of the elbow 23L need not be closed off as the elbow is retained in place by the pivot bolt 21 as seen in FIG. 6 and the attachment of the outer tube 15 to the upper surface of the elbow. But if someone is worried about small bugs getting into the tube, a suitable closure can be employed for the proximal end of elbow 23, adjacent the mount board 50.

A close inspection of the apparatus 10 is necessary to realize that the outer tube 16 is what is attached at the upper surface of elbow 23, but it is the middle tube 11 that passes up and down
through bore 26 on the underside of the elbow.

Returning momentarily to elbow 23, it is seen that the elbow is closed off at its distal end by a closure 25 such as a metal or plastic button, which of course can be a decorative element.

Figure 9:
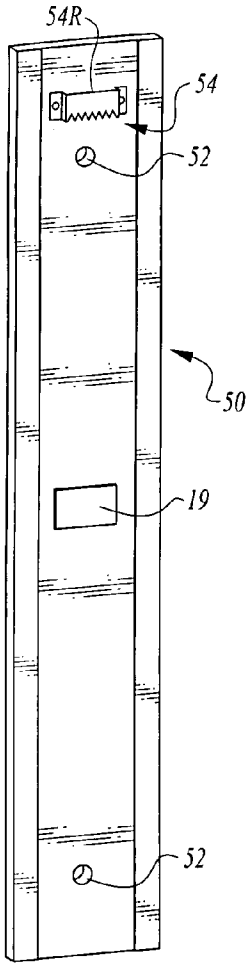
FIG. 9 is a top rear view of a portion of one mount board of this invention to illustrate the ability to mount the apparatus to a substrate.

Mount board 50 may be made of any suitable material, such as but not limited to plywood, solid wood, rigid plastic, medium density fiber board, or metal as may be desired. As seen in FIG. 9, the apparatus 10 can be mounted in two ways. One is to use a conventional keyhole slot, or a sawtooth hanger 54R on the back, to hang apparatus 10 on a screw of nail. Such mounting is semipermanent in that with a little effort, the apparatus can be removed from the substrate or wall to which it is attached. The second mode is to screw or nail the apparatus to a vertical surface through the two mounting holes 52, seen also in FIG. 2. There is no criticality to the placement of the bores 52 for wall mounting. Such determination is within the skill of the art.

Figure 2:
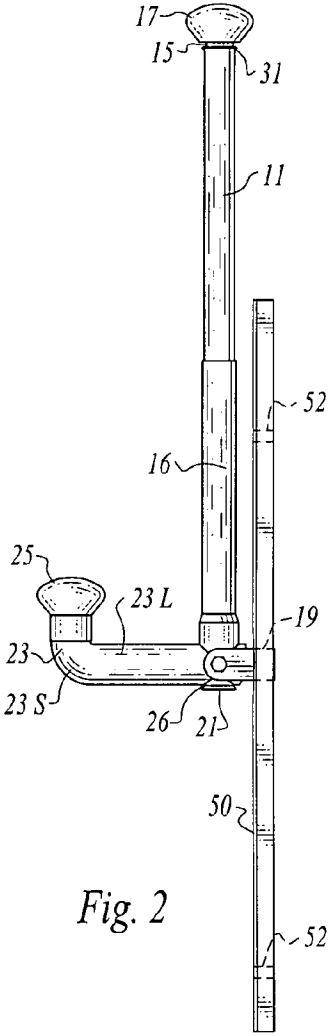
FIG. 2 is a side elevational view of this apparatus with the inner tube extended upwardly. The longer section 23-L of the elbow 23 is disposed horizontally The left side elevational view would be a mirror image thereof.

In FIG. 2, the apparatus 10 is seen from its left side. The right side view of this would be a mirror image of the left side. Here the curvature of the front surface of the first version of the mount board 50 can be readily seen. In this view the inner tube is not extended, as only a small portion of it is seen in an elevated position, extending from the middle tube 11. The middle tube is also elevated as substantially none of the middle tube is extending through opening 26. In this view the elbow 23's long section 23L is horizontal, which is the disposition for hanging a coat on the finial 25.

Figure 3:
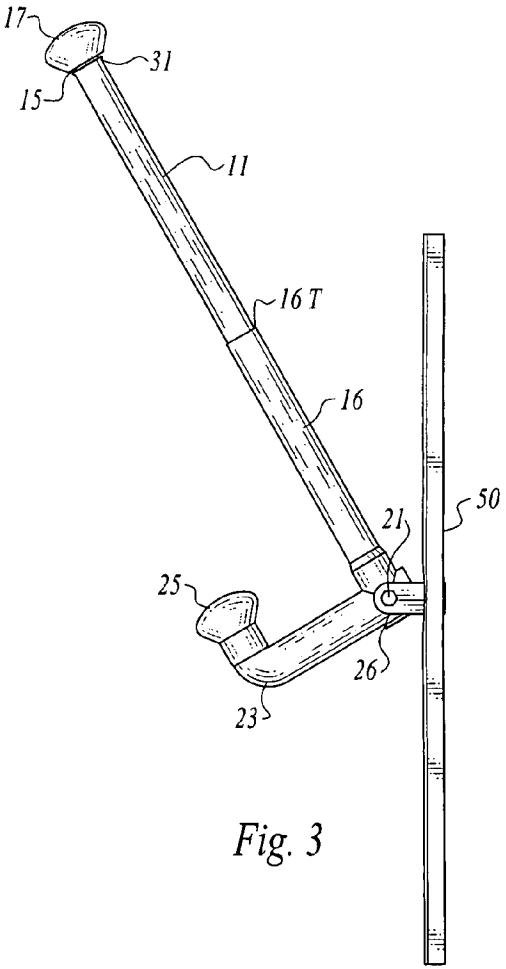
FIG. 3 is a view related to FIG. 2 at a different moment in time, showing the inner arm just slightly. and the apparatus partially rotated toward the horizontal position.

FIG. 3 depicts a later moment in time wherein the apparatus is being pivoted on the pivot bolt 21. The inner tube is in its normal disposition of having only a small amount of the section emerging from middle tube 11, while the outer tube 16 maintains its fixed position in the top of the section 23L of the elbow 23.

In FIG. 4, at a still further moment in time, the middle tube 11 is now in a horizontal disposition, as is the inner tube 15. Consequently section 23L of the elbow is now in a vertical disposition. But finial 25 can still be used for a coat or a hat. A series of hangers, be they wood suit hangers, or plastic hangers as used for blouses, sweaters and the like and be placed at various locations along outer tube 16 and middle tube 11, but note that inner tube 15 is not extended at this point in time.

FIG. 5 is but a moment in time just slightly past the time of FIG. 4. In FIG. 4 the outer tube 16, the middle tube 11 and the elbow 23 are all in the same disposition as FIG. 2, but the inner tube 15 has not been extended to provide additional hanging room. FIG. 5 is the next moment in time, wherein the inner tube 15 has been extended outwardly, such as to receive a large bath towel, 58, seen in phantom lines, and which is about to be folded over downwardly as signified by arrows A to be folded over the tubes 15 and 11.

FIG. 6 is a bottom plan closeup view of the apparatus as seen in its disposition in FIGS. 4 & 5. In this view one form of a closure 13 for the inner tube, not the middle tube, is seen apparently disposed in the bottom or lower end of middle tube 11. This closure 13 is in fact, a washer soldered within the lower end of the inner tube to prevent the inner tube 15 from exiting out the bottom of tube 11 when both are in a vertical disposition, or from exiting forward when both tubes are horizontal. The closure, washer 13, impacts the tong 33 soldered or welded into position on the edge at the bottom of the middle tube 11 and directed inwardly to prevent the washer, and thus the entire inner tube from exiting out the bottom of the middle tube. The washer 13 impacts the tong which acts as a downward movement stop.

This view also clearly depicts the recess 18 for the rims 20 of the U-shaped retainer 19—shown in FIG. 9.

FIG. 7 shows the cross section of the mount board 50, which is basically rectangular with chamfered or beveled front edges, 50-B. Closure buttons 17 for the upper end of the inner tube and button 25 the closure for the distal end of the elbow are seen in this top plan view.

In FIG. 8, the inner tube 15 is seen outside of its normal location, which is retained within the middle tube. The closure at the lower end of the inner tube 11, is a variant to the closure seen in FIG. 6 for the inner tube. The variant 33-V comprises the combination of slit 35 and inward crimp 34, disposed at the lower or bottom end of the inner tube. This version of the closure 33-V is preferred as it takes less time to make the slit and crimp than to solder the washer into position at the lower end of inner tube 15.

Figure 10:
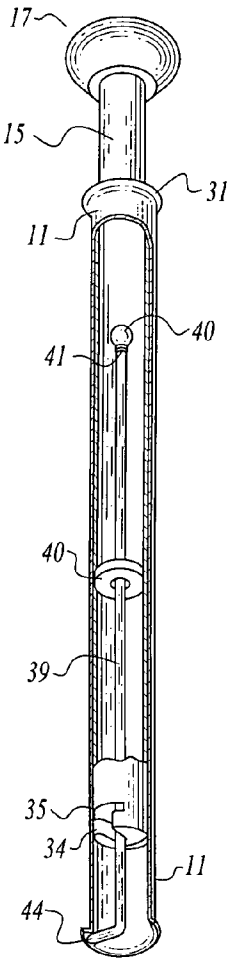
FIG. 10 is a cutaway diagrammatic view showing the assembly of the apparatus using the inner tube closure as seen in FIG. 8.

FIG. 8 only illustrates a portion of the inner tube. The contents of the inner tube are found in FIG. 10. Let us skip ahead to a discussion of FIG. 10. FIG. 10 is a cutaway view of the inner tube disposed within the middle tube. The balance of the apparatus has been omitted for ease of understanding. Finial 17 is seen disposed on the top of inner tube 15. Inner tube 15 is seen disposed within the middle tube 11. Crimp 34 and slit 35 in inner tube 15 are also seen and need no further discussion. Seen at the bottom end, or in the FIG. the left end of middle tube 11 is a solder connection 44 of one end of thin rigid copper wire or steel wire 39 which wire is disposed along the length of middle tube 11 up through the crimp 34 into inner tube 15. This wire 39 passes through a preferably rigid bead or button, or mini-washer 40 and the opposite end of said wire is curled slightly and a drop of solder applied only to the wire curl to prevent the wire curl from unraveling. The insertion of the bead and wire into the inner tube is obviously carried out prior to the addition of finial 17 during the construction phase of the apparatus.

When the inner tube 15 is fully extended, the bead remains stationary and impacts the inwardly extending crimp 34 to prevent the inner tube from being overly extended and thus falling out of the middle tube. The action is the same if the less preferred closure; namely, the washer as seen in FIG. 6 is employed at the bottom of the inner tube 15. The wire and bead should extend about ⅓rd of the length up into the inner tube. It bears repeating that the presence of finial 17 prevents the exiting of the inner tube out the bottom of the middle tube.

From a practical point of view it has been found that good results are obtained when the inner tube has a an outside diameter of about ⅜ inch, the middle tube about ½ inch and the outer tube has an outside diameter of about ⅝ths inch. If desired the outer surface of the inner and middle tubes can be sprayed with a thin coat of polytetrafluroethylene, such as sold under the brand Teflon®, to ease ingress and egress of the tubes. This feature needs no illustration.

In FIG. 9, a rear view of the first embodiment of the mount board, 50, the rear view thereof has a conventional keyhole mounting plated 54 disposed thereof for hanging the apparatus on a nail, screw, molly bolt, or even a picture hanger in a removable fashion. Designator 19 is the retainer base of the U-shaped retainer whose arms 20 are denoted in FIGS. 1 and 6. Also seen in this FIG. are two spaced through bores 52 for the receipt of screws or molly bolts for fixed mounting of the apparatus. One of these through bores is also seen in phantom line in FIG. 7.

Figure 11:
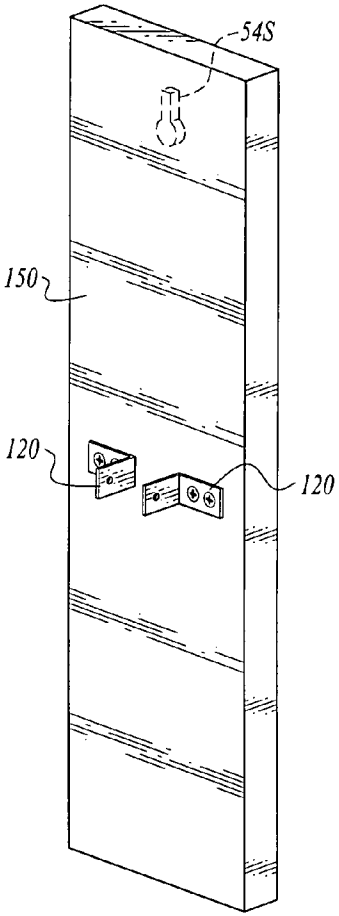
FIG. 11 shows a variant configuration for the retainer base and for the mount board.

Commencing in FIG. 11 variants using similar parts but in the 100 number series will be shown as a second embodiment. These 100 series numbers serve the same purpose as their two digit counterparts previously discussed. Here mount board 150, a fully rectangular board such as a nominal one inch solid wood member, is seen. This can be of any desired specie, such as mahogany, maple walnut etc. as may be if desired, of pseudo wood of wood grain plastic. Suitable thickness rigid plastic or anodized aluminum can also be employed. A pair of opposed L-brackets 120 in FIG. 11 are seen without the tube to be mounted to the L-brackets. Also seen in FIG. 11 is a wall mounting apparatus called an undercut key slot 54S, shown in phantom lines. A nail is placed part way into a wall and the nail head fits into the recess and then under slides upward into the hidden slot to hold the unit close to a wall. Similar mount means are found in wooden wall plaques.

In FIG. 12 et seq, the L-brackets are designated 56 and have a vertical section 56-V and a horizontal section 56-H are seen holding the second embodiment apparatus 100 in position on the mount board 150. See also FIG. 13.

Finials 117 and 125 which serve the same function as their two digit counterparts, have a flatter configuration than 17 and 25. Thus it is seen that there is no criticality in the shape or these two elements. Any suitable shape finial will serve as a resting place for a hat or jacket.

Figure 13:
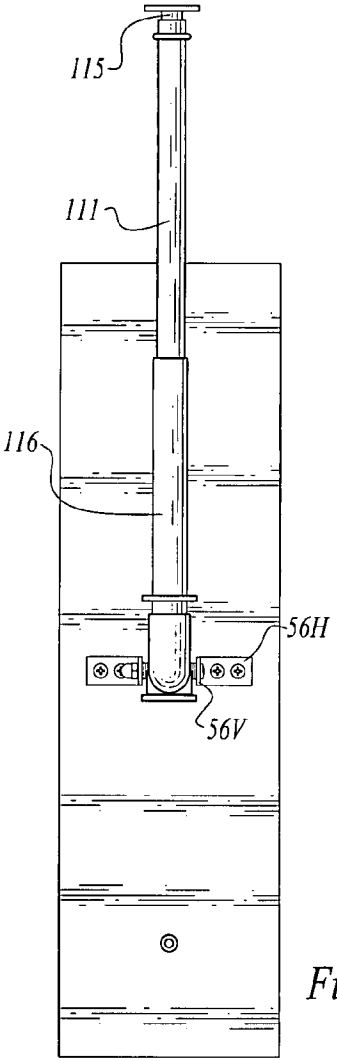
FIG. 13 is a front elevational view of the apparatus with the outer tube fully extended upward of the elbow and the inner tube slightly extended upwardly.

Whereas FIG. 12 is a side elevational view with the inner tube fully disposed vertically within the middle tube FIG. 13 is a front elevational view with the middle tube 111 fully raised up and the inner tube 115 only slightly extended upwardly from within the middle tube, (It is to be understood that this view defies the law of gravity, and as such is present for illustration purposes only, to show the motion needed to transition the inner tube and the middle tube from a vertical position to a horizontal position) It is to be understood that the modus operandi as set forth in connection with FIG. 10 also applies to the $2^{nd}$ embodiment.

Figure 15:
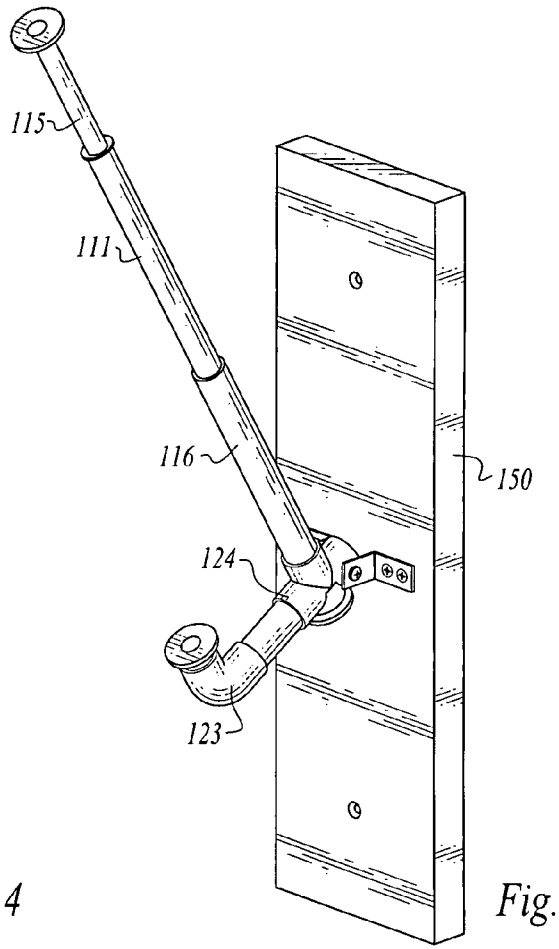
FIG. 15 is a side perspective view at a later moment time showing the three main tubes in an extended disposition, and the elbow frozen in a downward disposition.
Figure 14:
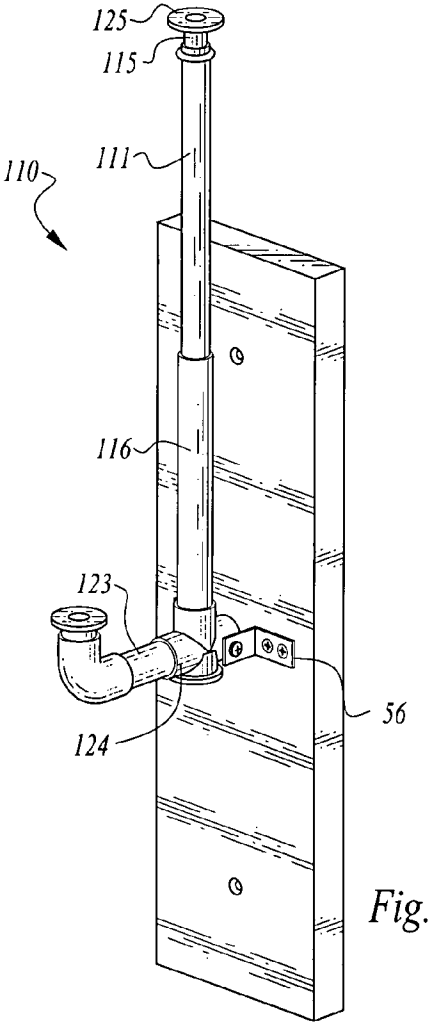
FIG. 14 is a side perspective view of the second embodiment version shown in its disposition in FIG. 12.
Figure 16:
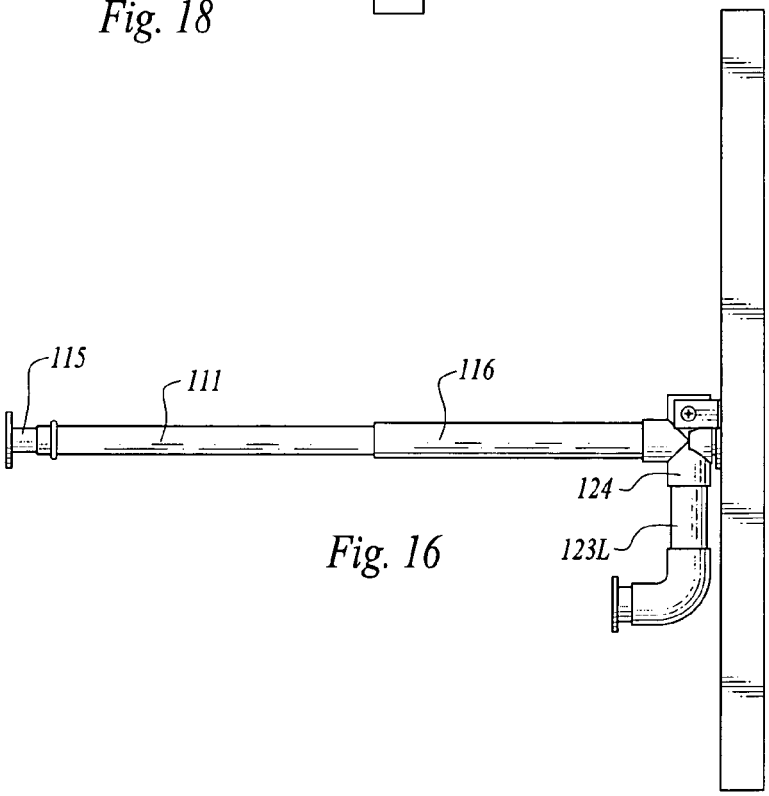
FIG. 16 is a side elevational view with the elbow rotated 90 degrees downwardly, the middle tube fully extended out, and the inner tube almost fully retracted into the outer tube.

FIG. 14 is related to FIG. 13 in that the vantage point has moved 90 degrees to the right and the inner tube remains only slightly extended upwardly. Whereas in FIG. 15, taken at a moment in time a few seconds later, the middle tube is seen almost fully elevated from within the outer tube 116, and the inner tube 115, is partially extended upwardly from the middle tube. And, all three tubes have been rotated 45 degrees leftwardly as has the elbow 123, which is fixedly attached to the outer tube. In FIG. 16, taken a few moments after the position of FIG. 15, the tubes are in a horizontal disposition. The middle tube is fully extended leftwardly from within the outer tube, but the inner tube is relocated back in the middle tube.

FIG. 14, also is for illustrative purposes and defies the law of gravity. This FIG. illustrates another, variant in construction of the apparatus. Here in the second embodiment of the invention, 100, elbow 123 does NOT extend all the way back to the retainer means. Instead, the arms of the retainer 56, are disposed through a Tee designated 124. A tee has four openings as does this one. Vertically, the outer tube's lower end is disposed in one opening, and as previously discussed, the middle tube shown with a closure thereon can pass through the lower vertical opening, but not up and out the top of the tee 56, and then the outer tube. The left horizontal tube receives the elbow, and the right horizontal opening may be left open or closed off conventionally as may be desired. All connections to the Tee are by soldering if the elements are brass or copper or steel, or adhesed using a product such as Loctite®680.

In FIG. 16, apparatus 110 has been rotated to its second position wherein the larger part of the elbow 123-L is vertically disposed and the outer tube 116 is horizontal from its first position, where the elements just mentioned are oppositely disposed. Note that the middle tube is extended leftwardly with only the closure thereof adjacent the Tee 124. In this view the inner tube 115 is just slightly extended.

Figure 17:
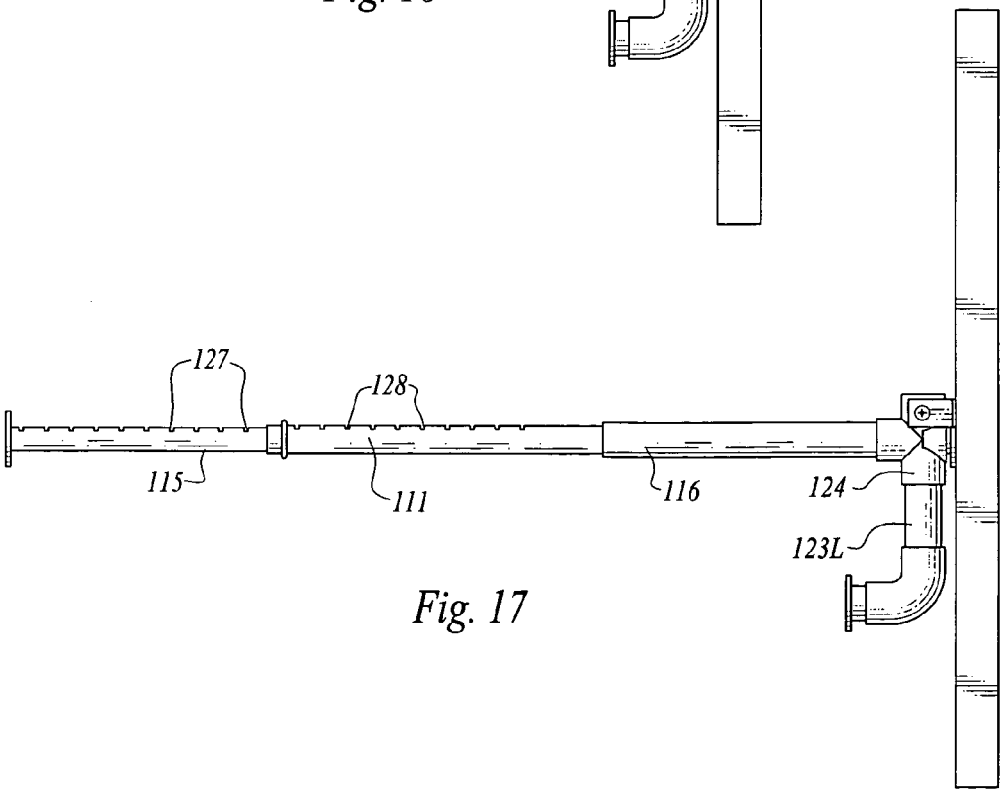
FIG. 17 is a view related to FIG. 16, but wherein the inner tube is partially extended outwardly and showing an alternate construction of the inner tube and middle tube with slots in the in the inner & middle tube in which hangers can rest without sliding.

FIG. 17 is a figure related to FIG. 5, in that the inner tube 115 is outwardly extended in a horizontal position. In this second embodiment, the inner tube 115 has a series of indents or recesses 127, sized to receive the curved wire portion of a series of coat hangers. By having the recesses therein, coat hangers can be placed specifically in the spaced recesses and as such will not slide along the tube lengths and the clothes item on each coat hanger will be spaced slightly from the next adjacent clothes item. Obviously this recess feature may be employed in any of the embodiments as well and as such no further illustration is needed. If desired upward extending spaced bumps, 128, can also, or instead of recesses on the inner tube, be placed on the middle tube to serve the same purpose of separating hangers along the length of the middle tube. It is also seen that the interior diameter of the outer tube would have to slightly enlarged to be able to utilize this bump feature and is within the skill of the art.

Figure 18:
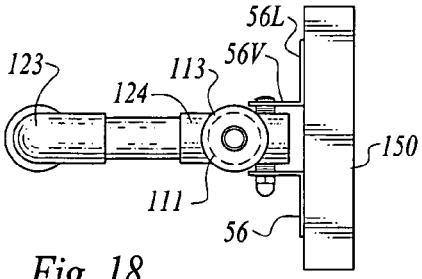
FIG. 18 is a bottom view of the second embodiment.

In FIG. 18, a bottom plan view the closure 113 for the middle tube is seen attached at the lower end of middle tube 111. The elbow 123 is seen but its junction with tee 124 is blocked from view in this figure. The proximal end of the tee 124 is seen adjacent mount board 150.

The discussion now moves to the third embodiment which operates in like manner as the first two embodiments but which has a partially different construction. The numbering for this third embodiment will be in the 300 series, wherein like parts will have similar numbers as the elements set forth in two digits, unless indicated to the contrary.

Figure 19:
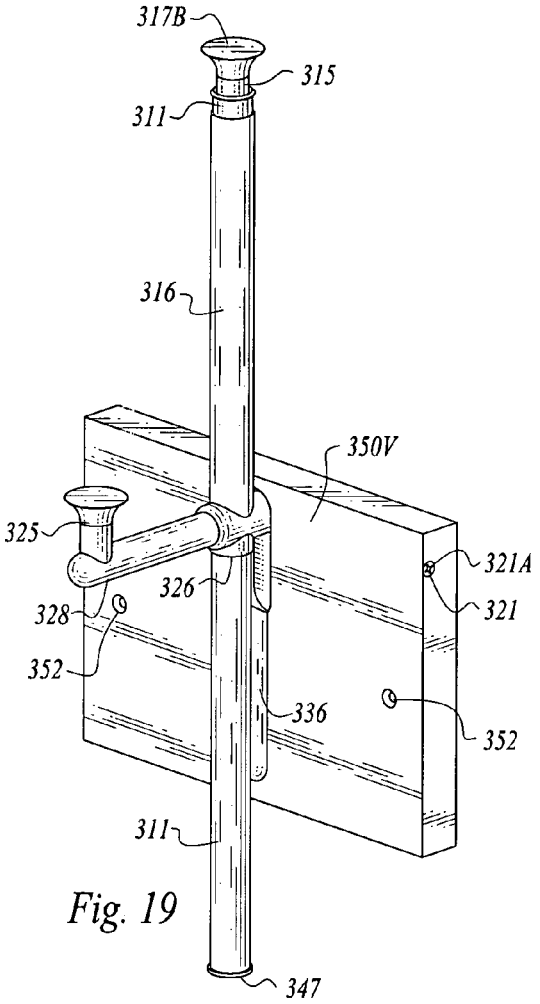
FIG. 19 is a left side perspective view of the third embodiment of this invention in "coat hook (CH) position" carrying two flat top finials and a different configuration mount base.

The discussion first turns to FIG. 19. There are big distinguishing features to be found in the third embodiment. The first is the hidden pivot pin with a lack of visible retainer means for the pin, and second the fact that the shortest member, that is, the one to which the coat hook finial 325, is attached is no longer a hollow elbow, but is now preferably an elongated solid metal or plastic bar having a bullet nose which is designated 328 and called a coat bar.

In FIG. 19, the apparatus is seen to be in "coat hook" position, hereinafter to be designated CH position as opposed to "towel bar" position, hereinafter TB position as per FIG. 20. Note the square shape of the mount board 350V the variant, versus standard 350.

The dome finial 17 of the earlier discussed embodiments, is seen in FIG. 19 to have been replaced by flat top finial 317B which is disposed at the top of the inner tube 15 as by gluing, soldering or welding, depending on the materials employed. Inner tube 15 is seen sticking slightly out of middle tube 11 in this FIG. The finial, when attached, prevents the inner tube from descending down into the middle tube 11. Both the middle tube and outer tube are substantially the same length, preferably about 12 inches long. The inner tube is preferably 0.50 inches in diameter, and the middle tube is preferably about 9/16ths inches in diameter. As can be seen the middle tube has an outward extending flare 347 at the bottom of the tube, which serves to prevent the middle tube from being removed upwardly through the outer tube 16.

Figure 21:
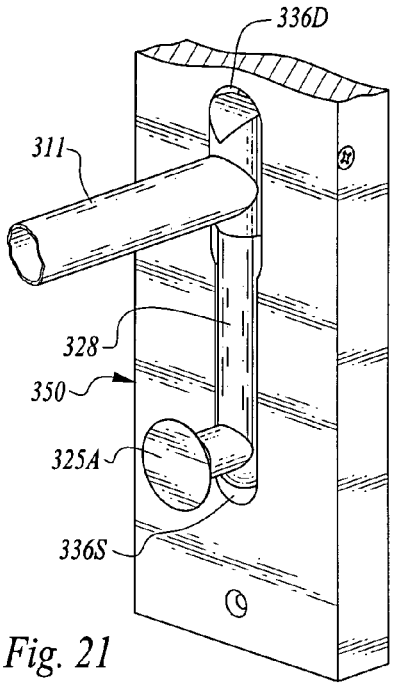
FIG. 21 is a truncated front perspective close up view of the third embodiment's lower area in "towel bar position" wherein the finial has a flat face.
Figure 22:
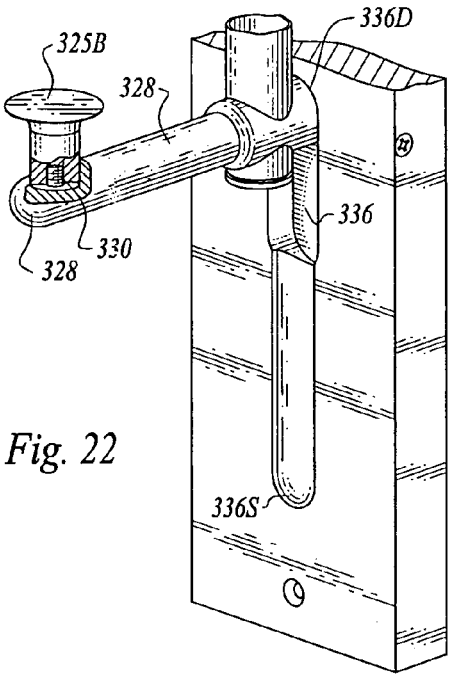
FIG. 22 is a front truncated perspective view of the third embodiment in a raised coat hook position to best illustrate the recess feature of this embodiment.
Figure 24:
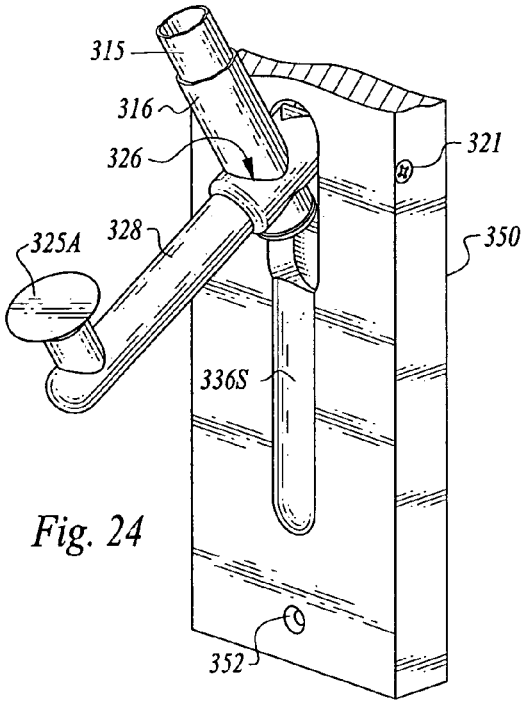
FIG. 24 is a top front truncated perspective view of the third embodiment being lowered into "towel bar position".

In this embodiment, cross member element 23, an elbow or elbow-like tube in the first embodiment, is replaced by either a tube or a solid bar 328, both of which would have a bullet shaped nose as seen in the front view FIG. 22, at the distal end thereof. Spaced in from the proximal end of the bar, which is not visible in this view as it is disposed within the preferably dual depth groove 336, seen in FIG. 21, is a throughbore 326. This through opening 326, in the top and bottom surface of the longer section of the coat bar 328, denoted in FIG. 24, is vertically aligned with the upper tube 326 to permit the middle tube 311 to pass through the outer tube which is disposed upon the coat bar around the periphery of this through opening, 328 such that the middle tube passes through the outer tube 316 and out the bottom of the coat bar 328. Note that here too, the outer tube does not pass through the cross member coat bar 328, but is 90 degrees thereto.

Figure 26:
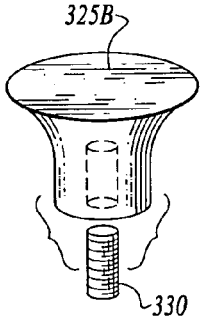
FIG. 26 is an elevational view of the flat top finial and the threaded stud used to secure it into position on the coat hook arm as in FIG. 24.

At the distal end of the coat bar 328, which preferably is round in cross section elongated machined brass bar, and upstanding therefrom is a finial 325B. The finial is designated 325B to distinguish it from the dome finial 325A, and designated 25 in the first embodiment. This finial 325B is best seen in FIG. 26, as is the mounting stud 330. This stud is dual threaded, that is ½ is threaded clockwise and other ½ is threaded counterclockwise. The counterclockwise threads are disposed in an unnumbered bore on the top surface of the coat bar, and the standard clockwise threads go into the underside female threads of finial 325B. For that matter any finial that is similarly threaded such as 325A, may employed at this location.

An elongated allen head threaded shaft 321, is disposed in one side of the base 321, in bore 321, through an unseen bore similar to bore 24 of FIG. 6 through the thickness of the coat bar. This allen head shaft is threaded into the base 350 an adequate amount past the location of the coat bar, to prevent the shaft from coming out on its own. The head of the threaded shaft 321 is recessed into the side of the base 350 to prevent it from accidentally coming loose. This threaded shaft serves as the pivot pin between the coat CH position disposition and the TB disposition of this apparatus.

Figure 20:
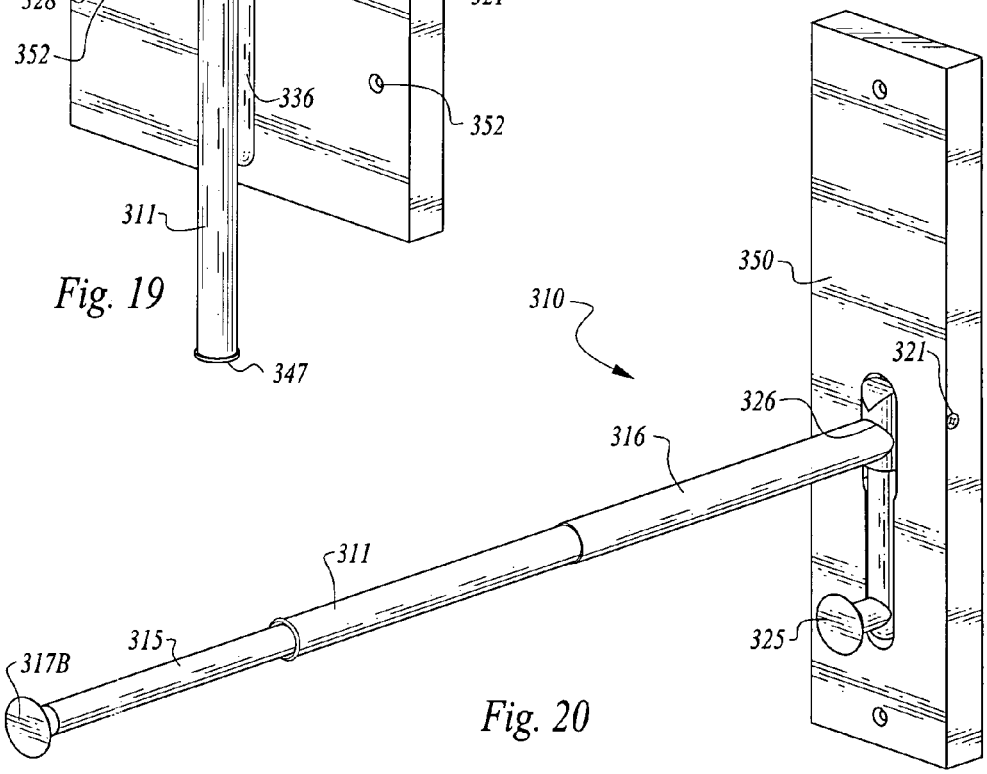
FIG. 20 is a left side perspective view of the third embodiment in "towel bar position", but with two flat face finials.

In FIG. 20 apparatus 300 is seen in TB position. Here a combination of finials are seen. These can be the same or different in size, and shape and face. The extended inner tube is seen to be capped off by finial 317B, the flat head finial, while the coat hook section has the domed finial 325A. Obviously these finials are interchangeable as may be desired. Other finial shapes not shown may also be employed. It is within the skill of the art to find suitable finials from the various manufacturers of same. Reference can also be made to the catalogs of drawer pull manufacturers as well, such as but not limited to Amerock®. Note the presence of the bore 321A for allen threaded shaft 321 discussed supra. Once oriented horizontally the inner tube may be returned inwardly or retained in an outward disposition If the inner tube has notches to space clothes changers, the outward position is preferred for maximum storage of clothes. The inward disposition of the inner tube is handy when only a towel is to be stored or dried as from pool or spa use.

In FIG. 21, the upper deeper portion 336D of the routed or gouged dual depth groove 336 can be seen, beneath the coat bar 328 in this lower front view of the 3$^{rd}$ embodiment, shown in TB disposition. This groove 336 is sized in elevation to be slightly longer than the extension of the short tube, such that the short tube 328, will nest therein as can be seen happening in FIG. 24. The dual depth has been found to be beneficial in that during the transition from CH to TB position the middle bar upon dropping does not get caught in the gouged out area 336. Plus the rear of element 328 is of a slightly greater diameter, so a deeper recess is needed but only for that part of element 328, the short tube.

In FIG. 22, which is a front elevational view in CH disposition, the bullet nose of the coat bar 328 is seen. Also shown in cutaway disposed within the finial 325B, is the stud 330 which was discussed previously. Seen here as well, is the lower portion of the groove 336. By having 336S only 0.25" versus 0.437", the long tubes are less liable to get caught in this groove and instead slide over it during change of positions from TB to CH position.

Figure 23:
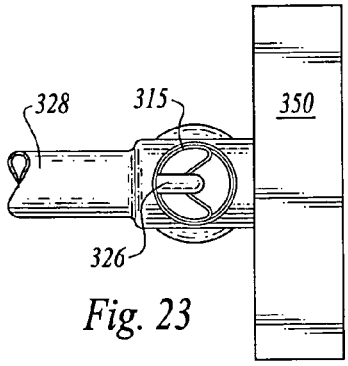
FIG. 23 is a bottom elevational view of the third embodiment of this invention.

Moving on to FIG. 23, which is a bottom plan view of the apparatus in CH position, the throughbore that passes through the coat bar 328 can be seen. Disposed therein is the middle tube 315 that can pass there through, as per FIG. 19. The mechanics of this embodiment will be discussed infra with respect to FIG. 25. A flat disk, not shown, can cover over 326.

In FIG. 24 which is a closeup in motion depiction of the apparatus almost in the TB position, we see the coat bar 328 out of the groove 336. Lower mounting hole 352 for reception of a screw or molly bolt is seen near the bottom of the base 350. In this Figure, dome finial 325A is seen in vertical disposition mounted on the coat bar 328, Middle tube 315 and outer tube 316 are also seen in this view. Note that the elevation of the outer tube may vary from between 3 inches and 6 inches as may be desired.

Figure 25:
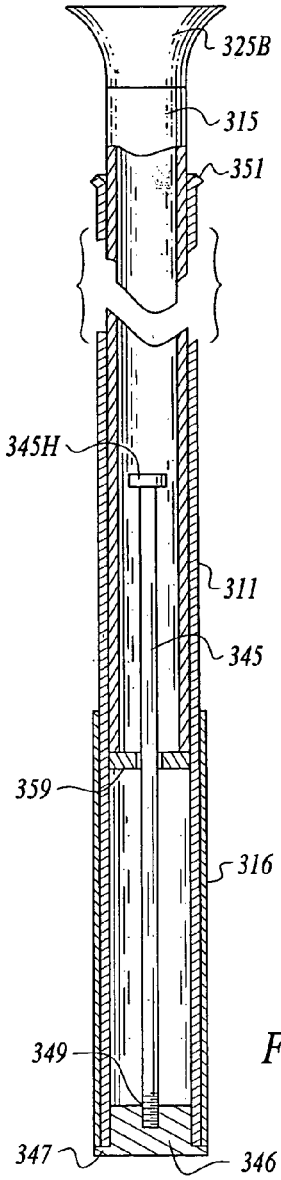
FIG. 25 is a cutaway diagrammatic view showing the assembly of the third embodiment of this apparatus using the inner tube closure as seen in FIG. 26.

FIG. 25 is a cutaway depiction of the three tubes inner tube, 315; the middle tube, 311; shown in cutaway, and the outer tube 316, also shown in cutaway fashion. At the top of the FIG. is seen finial 325B attached to the inner tube 315. (In this view the coat bar faces into the paper and is not seen). An annular closure such as a washer is attached at the bottom edge across the opening of the inner tube 315, but not until the head 345H of elongated screw 345 is first placed into the inner tube. As is seen this elongated screw 345 is threaded into flared closure 346 which threaded closure 346 has a female threaded area 349 for receipt of the threads of screw 345. The closure 359 restricts the movement of the inner tube 315 from exiting the top of the middle tube because the head 345 of the screw is wider than the opening of the washer 359. The circular flare 347 widens the lower end of the closure 346 to prevent the middle tube from exiting out the top of outer tube 316. Yet as we have seen the middle tube can move downwardly within the outer tube as per FIG. 19. In like manner a slight flare 351 prevents the middle tube from falling downwardly through the bottom of the outer tube. And the movement of the inner tube downwardly is restricted by the presence of the finial to prevent the inner tube from falling all the way into the middle tube. Embodiment #4 using square tubes, as discussed below operates in like manner as version #3 just discussed.

Thus it is seen that the third embodiment is an evolution of the first two embodiments and is cosmetically more appealing as the pivot pin is hidden from view. The operation is basically the same, that is the movement of the various elements relative to one another. However the retention mechanism internally is different as has been discussed.

Figure 28:
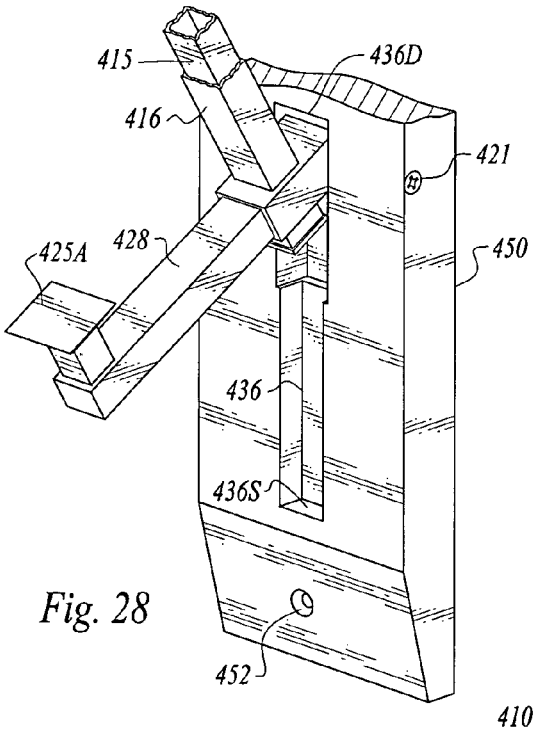
FIG. 28 is a view similar to FIG. 24 but for the fourth embodiment.
Figure 27:
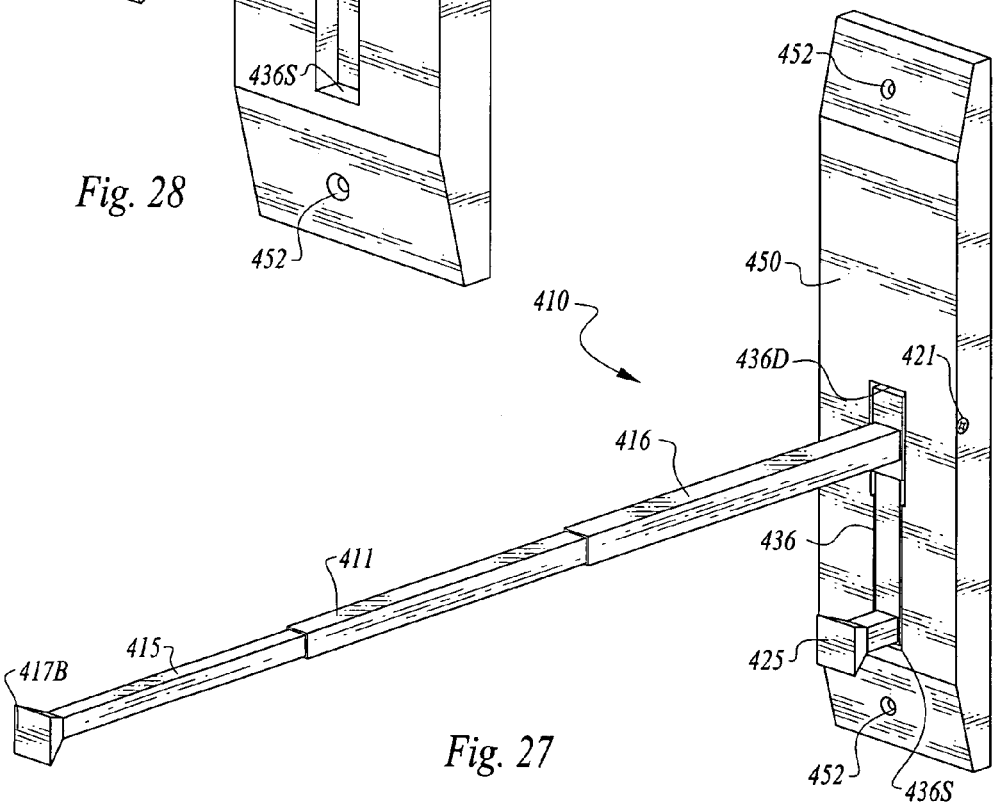
FIG. 27 is a view similar to FIG. 20 but for a fourth embodiment employing square tubing.

The discussion now moves to the fourth embodiment, which is based upon the third embodiment. Here in FIG. 27 a view similar to FIG. 20 is seen. There are two small differences. First all tubing in this embodiment 410, is square tubing instead of round tubing, for a fresh European look. However the mechanics of this embodiment are the exact same as for the third embodiment including the dual depth gouged out area, now designated 436S at the bottom for the shallower depth and 436D for the top for the deeper recess. The reasons for the dual depth recess is to keep the outside tube 416 or 316 from the previous embodiment from "hanging up" and being caught momentarily in the gouged out area during transitions from CH to TB orientation and back to CH position. However in order to ensure a good fit both structurally and cosmetically, the gouged out areas must have square corners, and should not be arcuate shape as in version 3. Reference is made to FIG. 28 which specifically illustrates the presence of dual square corner gouged out areas 436S at the bottom and 436D at the top of the gouged out area. Also note that to carry out the square configuration theme that the distal end of cross member 428 has been made flat, rather than bullet shaped for purely aesthetic reasons. Note further that to carry out the square theme, that the faces of the finials 417B and 425A are now preferably flat squares instead of being circular. All other elements in the 400 series numbers are the same as their 300 series counterparts unless specifically denoted.

Base 450 of the $4^{th}$ embodiment is also different. While the shape is basically rectangular, a large bevel has been made at the lop and bottom of the portrait position mount base 450. The bevel can range from about ⅞ths inch to about 1.5 inches on the front surface while the angle of the bevel can be from about 10 degrees to 20 degrees. Bevels of 1.25 inches at 15 degrees is deemed the most aesthetic.

While not shown specifically in the drawings, it is contemplated that the mount bases of any of the mount bases depicted may be chamfered at the edges for visual appeal. Chamfering is a well known wood worker's technique.

Modes of Use and Sizing

As per FIG. 9, which shows the back of one embodiment, the apparatus with its mount board can be slipped over a screw or nail which becomes disposed in one of the saw tooth slots 54 on the back side of the mount board whereby the head of the screw or nail slides under the portions 54-R and then gravity retains the apparatus on the nail or screw. See also the hidden recess mount in FIG. 11, shown in phantom lines. For a permanent mounting, screws of a suitable size such as #6 can be placed into the throughbores 52 and attached to a wood or other substrate directly such as a door frame or indirectly using Jordan™ anchors set into gypsum board.

For the four units discussed here, each of the inner and middle tubes should be about 12 inches in length and the outer tube should be about 6 inches in length. That way when the inner tube is extended upwardly/outwardly only about 6 to perhaps 8 inches is extended, the balance of it being retained in the middle tube for strength and rigidity. It has been found that up to 12 garments on hangers can be held on the inner and middle tubes, when the apparatus is extended in the TB position.

It is also contemplated that both larger and smaller versions of all embodiments can be manufactured for bath rooms and powder rooms, as well for dormitory use to substitute for a closet. Super large versions are anticipated for use out of doors by pools and hot tubs. The length of the coat bar and the elbow are substantially the same, about 3.75 inches in the embodiments discussed, but both are subject to lengthening as may be desired.

Obviously the dimensions set forth are not critical, and all elements can be longer or shorter. For a smooth operation of one tube inside another, it has been found that good results are obtained when the inner tube is 12 inches and about 0.5 inches in diameter; the middle tube is 12 inches long and 9⁄16ths in diameter, and the outer tube is 6 inches long and about ⅝ths inch in diameter. This gives a smooth operation up and down with no hang ups due to askew movement of one tube within the other or one tube hitting the mount board.

It is also to be seen that the apparatus of this invention can be utilized without the mount board. To do so, one could use a segment(s) or tab(s) of one gender of a hook and loop fastener on the back side of the retainer of the first embodiment and the opposite gender segment(s)/tab(s) of the hook and loop fastener can be applied to a substrate such as wall or door entry. Such fasteners are available in the marketplace under the brand Velcro®. Both of the first two versions of the apparatus could have the two arms of the mounting means screwed directly to a substrate rather than to the mount board. The third and fourth versions however are designed to be specifically used only with the mounting substrate, It is also to be noted that the third & fourth embodiments did not illustrate the notches and raised areas on the inner tube and optionally on the middle tube as well for specific spaced hanger retention, but such is contemplated for these embodiments as well.

In conclusion it is seen that we have invented an apparatus that can be used in two orientations. When the cross member elbow is in the normal J position, or the cross member coat tube or bar is vertical, per FIG. 20, the outer, middle and inner tubes, can be employed as a towel rack, and for the receipt of a plurality of coat hangers while the elbow can also serve as a coat hook if needed. When oriented with the tubes being vertical, only the cross member elbow of embodiments 1 & 2, now in the supine J position, or the cross member tube or coat bar is extended outwardly as in embodiments 3 & 4, this portion of the apparatus is better utilized as a hat rack or coat hook.

This apparatus is suitable for use in home kitchens, home bathrooms, as well as in dormitory rooms where closet storage space is at a premium. Two other locations where the apparatus may be used are cruise ship staterooms, as a place to put hangers carrying clothes of the stateroom's passenger (s), as well as in the cramped quarters of an RV, where it can be used in both the coat hook and towel positions as the need arises both in the galley as well as in the living quarters. Mention has already been made of using the apparatus on a fence or post near the pool or spa. Usage near a barbecue pit or gas fired barbecue to store aprons and tools on a rope are also contemplated.

While shown in most of the figures to be mounted on a base disposed vertically, the apparatus's mount base (board) can also be oriented horizontally. It is also within the scope of the invention to use a larger or square shaped base, such as seen in FIG. 19. Indeed, the base need not even be a quadrilateral. Round, hexagonal, diamond and octagonal shaped bases with non-equi-dimensioned sides or uniformly dimensioned sides are contemplated in both horizontal and vertical dispositions. Materials such as but not limited to hardwood, hard rubber, formed metal, plastic molded sections, vacuum metalized plastic, MDF, and other building materials are all suitable for the mount board of all embodiments.

Since certain changes may be made in the above described apparatus without departing from the scope of the invention herein involved, it is intended that all matter contained in the above description and shown in the accompanying drawings shall be interpreted as illustrative and not in a limiting sense.

We claim:

1. A multi-use apparatus for use as a coat hook, towel rack and clothes valet having a trio of tubes, which apparatus comprises:

(a) an outer tube of said trio having a first interior diameter, (b) a middle tube of said trio having an outside diameter, which is smaller than the interior diameter of the outer tube, and (c) an inner tube of said trio having an upper end, and an outside diameter smaller than an interior diameter of said middle tube, whereby the inner tube (c) is moveable within the middle tube, and the middle tube (b) is moveable within the outer tube;

(d) a cross member, selected from the group consisting of an elbow and an elongated coat bar, said cross member having a throughbore at its proximal end, and a finial at its distal end, said throughbore sized to permit said middle tube (c) to pass there through;

wherein the outer tube (c) is connected above and over the throughbore of said cross member, at a 90 degree disposition at the proximal end of said cross member;

means to prevent removal of said inner tube (c) from said middle tube (b), both upwardly and downwardly and means to prevent removal of said middle tube (b) from said outer tube (a), both upwardly and downwardly;

pivot means passing through said cross member rearwardly of said throughbore, to permit said cross member to rotate between a horizontal and a vertical disposition, and permit said trio of tubes to rotate between a vertical disposition and a horizontal disposition, simultaneously.

2. The apparatus of claim 1 wherein the pivot means is attached to a mount board.

3. The apparatus of claim 1, wherein a finial is the means attached to the upper end of said inner tube to prevent removal of said inner tube (c) downwardly from said middle tube.

4. The apparatus of claim 1 wherein the inner tube (c) and the middle tube (b) are about the same length, and the outer tube is about ½ the length of the inner tube and middle tube.

5. The apparatus of claim 1 wherein the proximal end of the cross member is disposed in a groove in a mount board, and the pivot means is a threaded shaft that enters said mount board, passes through the cross member and is secured past the cross member in said mount board.

6. The apparatus of claim 1 wherein the means to prevent removal of said middle tube (b) from said outer tube (a), upwardly is a flare that widens out the diameter of the middle tube at a bottom thereof.

7. The apparatus of claim 1 wherein the means to prevent removal of said middle tube (b) from said outer tube (a), downwardly is a flare that widens out the diameter of the middle tube at an upper edge thereof.

8. The apparatus of claim 1 wherein the means to prevent the inner tube (c) from exiting upwardly from said middle tube (b) comprises an annular closure at a bottom of the inner tube, and an elongated head bearing threaded shaft disposed in said inner tube, a head of which threaded shaft is larger in diameter than a diameter of a hole of the annular closure, said threaded shaft being engaged with a threaded closure at a bottom of the middle tube.

9. The apparatus of claim 1 wherein the means to prevent the inner tube (c) from exiting upwardly from said middle tube (b) comprises an annular closure at a bottom of the inner tube, and an elongated flexible wire having a sphere at one end disposed within the inner tube, a diameter of the sphere being greater than a diameter of an opening of the annular closure, to prevent passage there through, and wherein another end of the wire is attached to a bottom inside edge of the middle tube.

10. The apparatus of claim 1 wherein the cross member is a metallic elbow having the finial disposed over a curved end of the elbow.

11. The apparatus of claim 1 wherein the pivot means passes through said cross member rearwardly of said throughbore and comprises a pivot bolt disposed between a pair of arms.

12. The apparatus of claim 11 wherein the pivot means comprises a pivot bolt disposed between the pair of spaced arms forming parts of a generally U-shaped retainer base.

13. In combination, the apparatus of claim 1 disposed upon a mount board.

14. In combination the apparatus of claim 11 disposed upon a mount board, said mount board having an elongated vertical recess therein wherein the pivot bolt overlies said recess.

15. The apparatus of claim 5 wherein the cross member comprises a coat bar comprising an elongated metal bar having a bullet nose, and having the finial disposed normal to and adjacent the bullet nose.

16. In combination, the apparatus of claim 1 disposed upon a mount board, said mount board having an elongated vertical recess therein, and wherein the finial is a flat top finial.

17. A multi-use apparatus for use as a coat hook, towel rack and clothes valet having a trio of tubes selected from the group consisting of round tubes and square tubes, which apparatus comprises:

(a) an outer tube of said trio having a first interior diameter, (b) a middle tube of said trio having an outside diameter, which is smaller than the interior diameter of the outer tube, and (c) an inner tube of said trio having an upper end, and an outside diameter smaller than an interior diameter of said middle tube, whereby the inner tube (c) is moveable within the middle tube, and the middle tube (b) is moveable within the outer tube;

(d) a cross member, comprising an elongated tube or bar having a finite length and, having a throughbore at its proximal end, and a flat top finial connected normal to the length of said tube or bar at the distal end of said tube or bar, said throughbore sized to permit said middle tube (c) to pass there through;

wherein the outer tube (c) is connected above and over the throughbore of said cross member, at a 90 degree disposition at the proximal end of said cross member;

means to prevent removal of said inner tube (c) from said middle tube (b) downwardly, said means being a flat top finial and means to prevent removal of said inner tube upwardly from said middle tube, and means to prevent removal of said middle tube (b) from said outer tube (a), upwardly and downwardly;

pivot means passing through said cross member rearwardly of said throughbore, to permit said cross member to rotate between a horizontal and a vertical disposition, and permit said trio of tubes to rotate between a vertical disposition and a horizontal disposition, wherein the pivot means is a threaded shaft that enters a mount board, and said threaded shaft passes through the cross member and is secured past the cross member in said mount board thereby attaching the apparatus to the mount board, said mount board having a gauged out channel slightly longer than the length of the cross member.

18. The apparatus of claim 17 wherein the means to prevent the inner tube (c) from exiting upwardly from said middle tube (b) comprises an annular closure with an opening therein, at a bottom of the inner tube, and an elongated flexible wire having a sphere with a finite diameter at one end disposed within the inner tube, the diameter of the sphere being greater than a diameter of the opening of the annular closure, to prevent passage there through, and wherein another end of the wire is attached to a bottom inside of the middle tube.

19. The apparatus of claim 17 wherein the means to prevent removal of said middle tube (b) from said outer tube (a), upwardly is a flare that widens out a diameter of the middle tube at a bottom thereof; and further wherein the means to prevent removal of said middle tube (b) from said outer tube (a), downwardly is a flare that widens out the diameter of the middle tube at the upper end thereof.

20. The apparatus of claim 17 wherein the trio of tubes are round tubes.

21. The apparatus of claim 17 wherein the trio of tubes are square tubes.

22. The apparatus of claim 21 wherein the mount base is oriented portrait position, and the front surface of the mount base is beveled at its top and bottom edges.

23. The apparatus of claim 17 wherein the finial attached to the cross member has a flat square face.

24. The apparatus of claim 19 wherein the cross member is a bullet nosed bar.

25. The apparatus of claim 19 wherein the cross member is a square tube.

26. The apparatus of claim 1 wherein the inner tube has a series of spaced recesses therein to separate hangers when hangers are placed thereon.

27. The apparatus of claim 1 wherein the middle tube has spaced raised bumps to separate hangers when hangers are placed thereon.

28. The apparatus of claim 26 wherein the middle tube has spaced raised bumps to separate hangers when hangers are placed thereon.

* * * * *